US011411360B2

(12) United States Patent
Jung et al.

(10) Patent No.: US 11,411,360 B2
(45) Date of Patent: Aug. 9, 2022

(54) CONNECTOR HAVING JOINT WITH LIMITED RANGE OF MOTION

(71) Applicant: GigaLane Co., Ltd., Hwaseong-si (KR)

(72) Inventors: Kyung Hun Jung, Hwaseong-si (KR); Sun Hwa Cha, Hwaseong-si (KR); Hwa Yoon Song, Hwaseong-si (KR); Chang Hyun Yang, Hwaseong-si (KR); Jae Jun Lee, Hwaseong-si (KR); Sang Min Seo, Hwaseong-si (KR); Hee seok Jung, Hwaseong-si (KR)

(73) Assignee: GIGALANE CO., LTD., Hwaseong-si (KR)

( * ) Notice: Subject to any disclaimer, the term of this patent is extended or adjusted under 35 U.S.C. 154(b) by 118 days.

(21) Appl. No.: 17/037,861

(22) Filed: Sep. 30, 2020

(65) Prior Publication Data

US 2021/0143596 A1 May 13, 2021

(30) Foreign Application Priority Data

Nov. 8, 2019 (KR) ..... 10-2019-0142469

(51) Int. Cl.

*H01R 35/00* (2006.01)
*H01R 24/38* (2011.01)
*H01R 12/91* (2011.01)

(52) U.S. Cl.

CPC ..... *H01R 35/00* (2013.01); *H01R 12/91* (2013.01); *H01R 24/38* (2013.01); *H01R 2201/02* (2013.01)

(58) Field of Classification Search

CPC .... H01R 35/00; H01R 2201/02; H01R 12/91; H01R 24/38; H01R 24/542; H01R 24/54
See application file for complete search history.

(56) References Cited

U.S. PATENT DOCUMENTS 8,801,459 B2 * 8/2014 Mrowka ..... H01R 24/50 439/246
10,916,902 B2 * 2/2021 Maki ..... H01R 12/7082
2015/0118899 A1 4/2015 Hugel

FOREIGN PATENT DOCUMENTS

CN 109038130 A 12/2018
DE 102016002408 A1 8/2017

(Continued)

*Primary Examiner* — Oscar C Jimenez
*Assistant Examiner* — Paul D Baillargeon
(74) *Attorney, Agent, or Firm* — Brundidge & Stanger, P.C.

(57) ABSTRACT

The present invention relates to a connection having a joint with a limited range of motion, the connector including: a connection connector including a connection signal pin, a connection dielectric surrounding the connection signal pin, and a connection ground electrically insulated from the connection signal pin by the connection dielectric; and a first fixed connector into which one side of the connection connector is inserted and which allows a joint of the connection connector to move on the basis of the inserted one side of the connection connector, wherein the connection ground includes a connection protruding portion formed so that one end of the connection ground protrudes outward, a connection limiting portion which is adjacent to the connection protruding portion, has a thickness smaller than a thickness of the connection protruding portion, and comes in contact with an inner side of the first fixed connector to limit a range of motion of the joint of the connection connector, a connection elastic portion which is adjacent to the connection limiting portion and has a thickness smaller than a thickness of the connection limiting portion, and a plurality of connection slits which are formed along a circumference of the connection protruding portion and extend from one end of the connection connector in a longitudinal direction of the connection connector so that the connection protrud- (Continued)

ing portion, the connection limiting portion, and the connection elastic portion are separated into a plurality of pieces.

15 Claims, 10 Drawing Sheets

(56) References Cited

FOREIGN PATENT DOCUMENTS

| | | | |
|---|---|---|---|
| EP | 3547459 | A1 | 10/2019 |
| KR | 101926503 | B1 | 12/2018 |
| KR | 102006131 | B1 | 8/2019 |
| TW | 201737577 | A | 10/2017 |

* cited by examiner

CONNECTOR HAVING JOINT WITH LIMITED RANGE OF MOTION

CROSS-REFERENCE TO RELATED APPLICATION

This application claims the benefit under 35 U.S.C. § 119 of a Korean patent application No. 10-2019-0142469 filed on Nov. 8, 2019 in the Korean Intellectual Property Office, the entire disclosure of which is hereby incorporated herein by reference.

TECHNICAL FIELD

The present invention relates to a connector having a joint with a limited range of motion.

BACKGROUND

Connectors are used for electrical connection between a first substrate and a second substrate in an antenna module.

As illustrated in FIG. 1, as the connectors, a first fixed connector (100) and a connection connector (300) of which one side is inserted into the first fixed connector (100) and a joint moves on the basis of the first fixed connector (100) are disposed on the first substrate, and a second fixed connector (200) is disposed on the second substrate.

As illustrated in FIG. 2, when a distance between the first substrate and the second substrate decreases, the other side of the connection connector (300) is inserted into the second fixed connector (200), and the first fixed connector (100) and the second fixed connector (200) transmit high-frequency current to each other via the connection connector (300).

Here, when the first fixed connector (100) and the second fixed connector (200) are not vertically collinear, the joint of the connection connector (300) moves and the other end of the connection connector (300) is inserted into the second fixed connector (200) along an inner wall of a guide portion (231) of the second fixed connector (200).

Also, the inner wall of the guide portion (231) may have a shape in which a diameter decreases in an upward direction so that the other end of the connection connector (300) is guided into the second fixed connector (200).

However, as illustrated in FIG. 3, in the case in which a diameter (X1) of one end of the inner wall of the guide portion (231) is smaller than a range of motion (X2) of the joint of the connection connector (300), the other end of the connection connector (300) is caught instead of being inserted into the second fixed connector (200).

Therefore, since the diameter (X1) of the one end of the inner wall of the guide portion (231) should be formed larger than the range of motion (X2) of the joint of the connection connector (300), there is a limitation in minimizing the size of the guide portion (231), and thus there is a problem in that the width of the guide portion (231) increases.

With the recent development of the communication environment, a plurality of antennas and a plurality of connectors which correspond one-to-one to the plurality of antennas are used in an antenna module. Thus, proportionally to the increased width of the guide portion (231) of each connector, a distance between the connectors also increases, which results in an increase in the size of the antenna module. In this way, the above-mentioned problem acts as a factor that impedes the trend toward the size reduction of the antenna module.

SUMMARY

Technical Problem

The present invention is directed to providing a connector having a joint with a limited range of motion.

Technical Solution

A connector having a joint with a limited range of motion according to an embodiment of the present invention includes: a connection connector including a connection signal pin, a connection dielectric surrounding the connection signal pin, and a connection ground electrically insulated from the connection signal pin by the connection dielectric; and a first fixed connector into which one side of the connection connector is inserted and which allows a joint of the connection connector to move on the basis of the inserted one side of the connection connector, wherein the connection ground includes a connection protruding portion formed so that one end of the connection ground protrudes outward, a connection limiting portion which is adjacent to the connection protruding portion, has a thickness smaller than a thickness of the connection protruding portion, and comes in contact with an inner side of the first fixed connector to limit a range of motion of the joint of the connection connector, a connection elastic portion which is adjacent to the connection limiting portion and has a thickness smaller than a thickness of the connection limiting portion, and a plurality of connection slits which are formed along a circumference of the connection protruding portion and extend from one end of the connection connector in a longitudinal direction of the connection connector so that the connection protruding portion, the connection limiting portion, and the connection elastic portion are separated into a plurality of pieces.

According to an embodiment, a taper may be formed on a boundary surface between the connection limiting portion and the connection elastic portion, and a thickness may gradually decrease from the connection limiting portion to the connection elastic portion.

According to an embodiment, the first fixed connector may include a first ground forming the inner side of the first fixed connector into which the one side of the connection connector is inserted, and the first ground may include a limiting support portion which has a vertical surface protruding toward the inner side of the first fixed connector at a position corresponding to the connection limiting portion.

According to an embodiment, the first fixed connector may include a first ground forming the inner side of the first fixed connector into which the one side of the connection connector is inserted, and the first ground may include an inclined portion which is disposed below the limiting support portion and along which a diameter of a space into which the connection connector is inserted gradually narrows downward.

A connector having a joint with a limited range of motion according to an embodiment of the present invention includes: a connection connector including a connection signal pin, a connection dielectric surrounding the connection signal pin, and a connection ground electrically insulated from the connection signal pin by the connection dielectric; and a first fixed connector into which one side of the connection connector is inserted and which allows a joint of the connection connector to move on the basis of the inserted one side of the connection connector, wherein the connection ground includes a connection protruding portion formed so that one end of the connection ground protrudes outward, a connection limiting portion which is adjacent to the connection protruding portion, has a thickness smaller than a thickness of the connection protruding portion, and has a rubber ring, of which a portion is exposed, inserted into a groove formed along a circumference thereof to limit a range of motion of the joint of the connection connector, a connection elastic portion which is adjacent to the connection limiting portion and has a thickness smaller than a thickness of the connection protruding portion, and a plurality of connection slits which are formed along a circumference of the connection protruding portion and extend from one end of the connection connector in a longitudinal direction of the connection connector so that the connection protruding portion, the connection limiting portion, and the connection elastic portion are separated into a plurality of pieces.

A connector having a joint with a limited range of motion according to an embodiment of the present invention includes: a connection connector including a connection signal pin, a connection dielectric surrounding the connection signal pin, and a connection ground electrically insulated from the connection signal pin by the connection dielectric; a first fixed connector into which one side of the connection connector is inserted and which allows a joint of the connection connector to move on the basis of the inserted one side of the connection connector; and an elastic limiting portion which provides a relative elastic force along a circumference of an inner side of the first fixed connector to limit a range of motion of the joint of the connection connector.

According to an embodiment, the first fixed connector may include a first ground forming the inner side of the first fixed connector into which the one side of the connection connector is inserted, the first ground may include a fixed wall portion which is formed to extend upward from the first ground and has a hollow formed therein, and the elastic limiting portion may come in contact with the fixed wall portion to form an elastic restoration force.

According to an embodiment, the elastic limiting portion may include a body portion having a hollow, into which the connection connector is inserted, formed therein that is formed by bending a pressed metal plate member, a plurality of extending portions which are formed with slits therebetween and extend to be curved in a direction opposite to an extending direction of the body portion from one end of the body portion to face the body portion, and a contact portion which extends to be curved inward from one end of the extending portion and has a curved surface, which comes in contact with the first fixed connector, formed at an outer side.

A connector having a joint with a limited range of motion according to an embodiment of the present invention includes: a connection connector including a connection signal pin, a connection dielectric surrounding the connection signal pin, and a connection ground electrically insulated from the connection signal pin by the connection dielectric; a first fixed connector into which one side of the connection connector is inserted and which allows a joint of the connection connector to move on the basis of the inserted one side of the connection connector; and a spring which is supported by the connection connector and the first fixed connector and provides an elastic restoration force, which restores distortion caused by motion of the joint of the connection connector, to limit a range of motion of the joint of the connection connector, wherein the first fixed connector includes a first ground forming the inner side of the first fixed connector into which the one side of the connection connector is inserted, the first ground includes a fixed wall portion which is formed by one end of the first fixed connector extending upward and has a hollow formed therein and a first stepped portion which has a flat area that is disposed at an inner side of the fixed wall portion and is perpendicular to the fixed wall portion, the connection ground includes a second stepped portion which has a flat area that protrudes from the connection ground at a position corresponding to the first stepped portion and is perpendicular to the connection ground, the spring is supported by one end coming in contact with the first stepped portion and the other end coming in contact with the second stepped portion, and a portion between the first stepped portion and the second stepped portion is surrounded by the fixed wall portion.

According to an embodiment, the connection ground may include a connection protruding portion formed so that one end of the connection ground protrudes outward, a connection limiting portion which is adjacent to the connection protruding portion, has a thickness smaller than a thickness of the connection protruding portion, and comes in contact with an inner side of the first fixed connector to limit a range of motion of the joint of the connection connector, a connection elastic portion which is adjacent to the connection limiting portion and has a thickness smaller than a thickness of the connection limiting portion, and a plurality of connection slits which are formed along a circumference of the connection protruding portion and extend from one end of the connection connector in a longitudinal direction of the connection connector so that the connection protruding portion, the connection limiting portion, and the connection elastic portion are separated into a plurality of pieces.

According to an embodiment, the connection ground may include a connection protruding portion formed so that one end of the connection ground protrudes outward, a connection limiting portion which is adjacent to the connection protruding portion, has a thickness smaller than a thickness of the connection protruding portion, and has a rubber ring, of which a portion is exposed, inserted into a groove formed along a circumference thereof to limit a range of motion of the joint of the connection connector, a connection elastic portion which is adjacent to the connection limiting portion and has a thickness smaller than a thickness of the connection protruding portion, and a plurality of connection slits which are formed along a circumference of the connection protruding portion and extend from one end of the connection connector in a longitudinal direction of the connection connector so that the connection protruding portion, the connection limiting portion, and the connection elastic portion are separated into a plurality of pieces.

Advantageous Effects

A range of motion of a joint of a connection connector can be limited.

BRIEF DESCRIPTION OF DRAWINGS

Exemplary embodiments of the present disclosure will be described with reference to the accompanying drawings described below, and similar reference numerals denote similar elements, but the present disclosure is not limited thereto.

DETAILED DESCRIPTION

Hereinafter, embodiments of the present invention will be described in detail with reference to the accompanying drawings to allow those of ordinary skill in the art to which the present invention pertains to easily practice the present invention.

The present invention may be implemented in various different forms and is not limited to the embodiments described herein.

Connectors are used for electrical connection between a first substrate and a second substrate in an antenna module.

Figure 1:
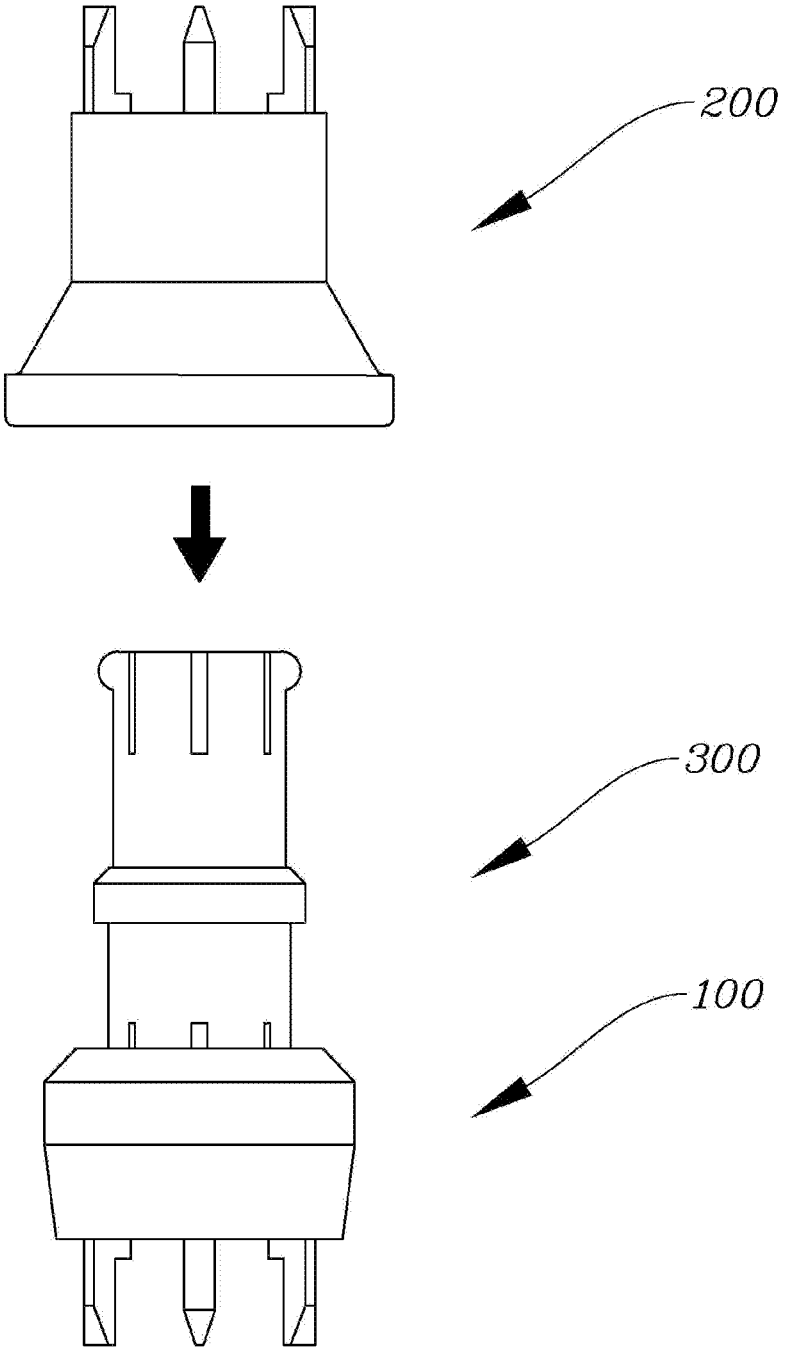
FIGS. 1 to 3 are views for describing a conventional connector.

As illustrated in FIG. 1, as the connectors, a first fixed connector 100 and a connection connector 300 of which one side is inserted into the first fixed connector 100 and joint moves on the basis of the first fixed connector 100 are disposed on the first substrate, and a second fixed connector 200 is disposed on the second substrate.

Figure 2:
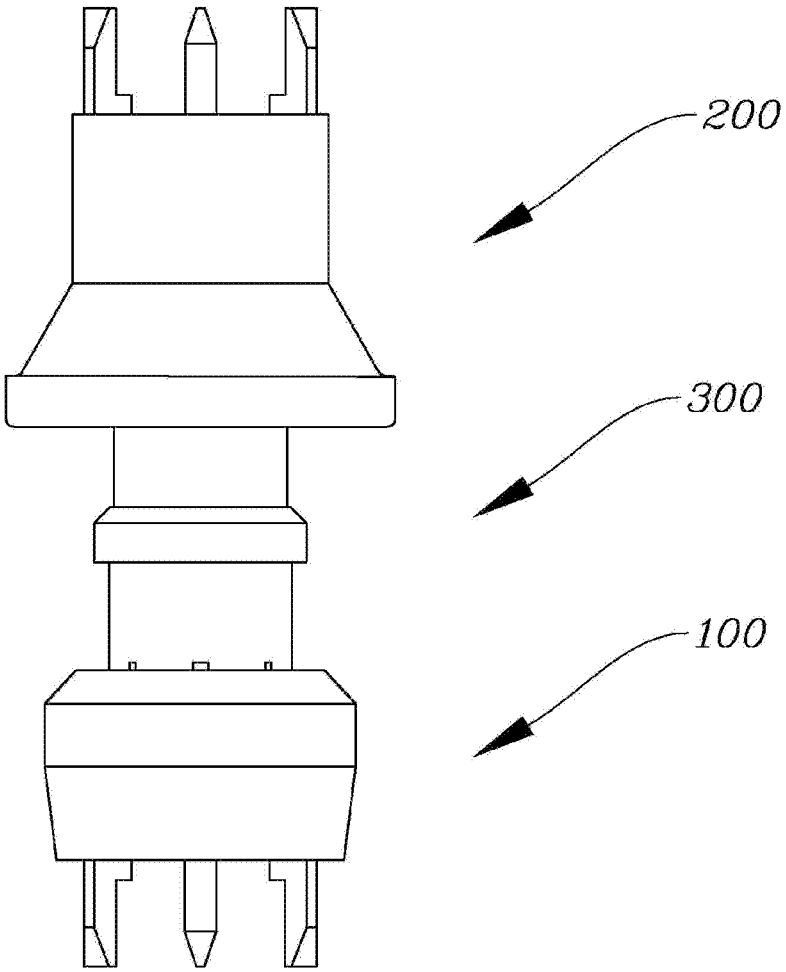

As illustrated in FIG. 2, when a distance between the first substrate and the second substrate decreases, the other side of the connection connector 300 is inserted into the second fixed connector 200, and the first fixed connector 100 and the second fixed connector 200 transmit high-frequency current to each other via the connection connector 300.

Here, when the first fixed connector 100 and the second fixed connector 200 are not collinear vertically, the joint of the connection connector 300 moves and the other end of the connection connector 300 is inserted into the second fixed connector 200 along an inner wall of a guide portion 231 of the second fixed connector 200.

Also, the inner wall of the guide portion 231 may have a shape in which a diameter decreases in an upward direction so that the other end of the connection connector 300 is guided into the second fixed connector (200).

Figure 3:
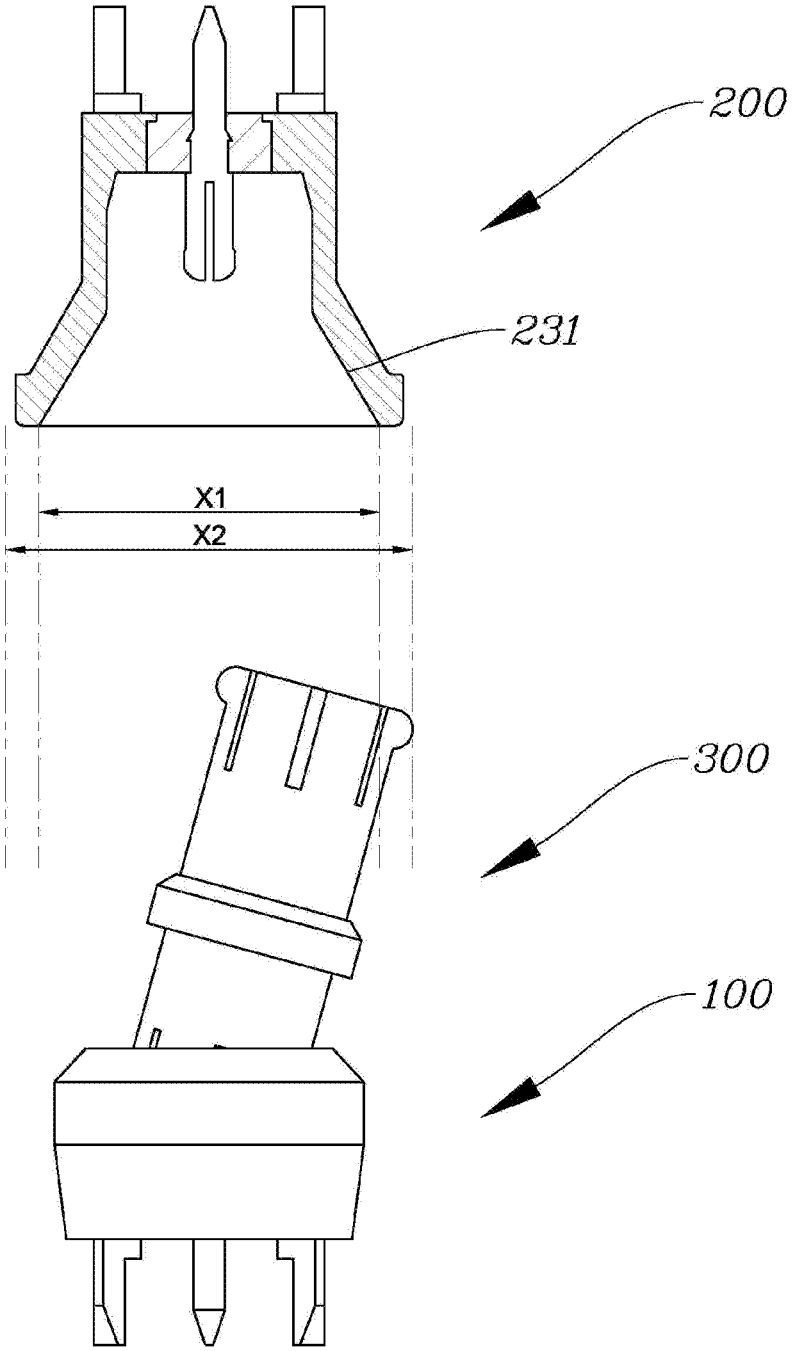

However, as illustrated in FIG. 3, in a case in which a diameter X1 of one end of the inner wall of the guide portion 231 is smaller than a range of motion X2 of the joint of the connection connector 300, the other end of the connection connector 300 is caught instead of being inserted into the second fixed connector 200.

Therefore, since the diameter X1 of the one end of the inner wall of the guide portion 231 should be formed larger than the range of motion X2 of the joint of the connection connector 300 and thus there is a limitation in minimizing the size of the guide portion 231, there is a problem in that the width of the guide portion 231 increases.

With the recent development of the communication environment, a plurality of antennas and a plurality of connectors which correspond one-to-one to the plurality of antennas are used in an antenna module. Thus, proportionally to the increased width of the guide portion 231 of each connector, a distance between the connectors also increases, which results in an increase in the size of the antenna module. In this way, the above-mentioned problem acts as a factor that impedes the trend toward the size reduction of the antenna module.

Figure 4:
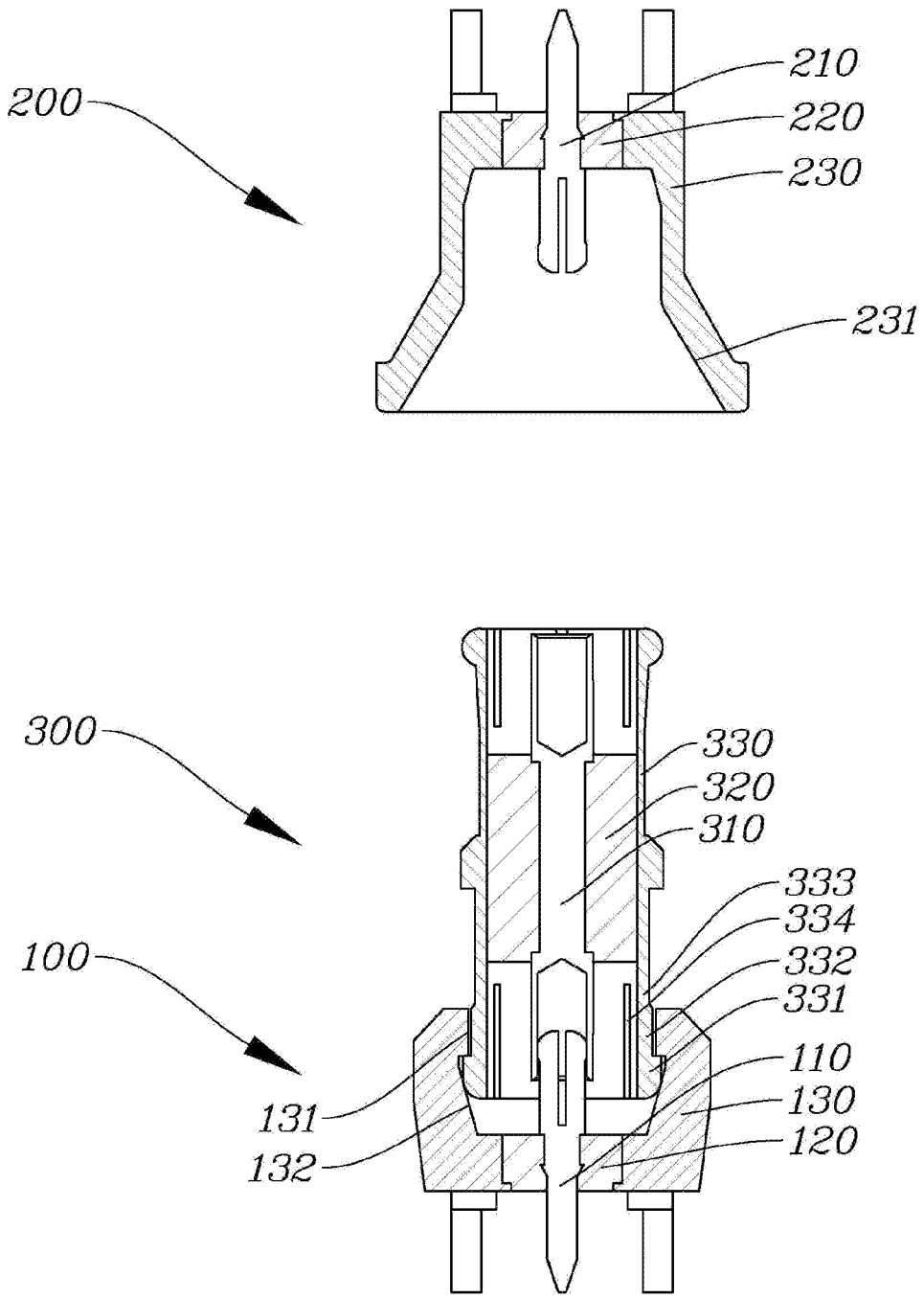
FIGS. 4 and 5 are views for describing a connector having a joint with a limited range of motion according to a first embodiment of the present invention.

In order to address such a problem, as illustrated in FIG. 4, a connector having a joint with a limited range of motion according to a first embodiment of the present invention includes a connection connector 300, a first fixed connector 100, and a second fixed connector 200.

The connection connector 300 includes a connection signal pin 310 configured to transmit high-frequency current, a connection dielectric 320 surrounding the connection signal pin 310, and a connection ground 330 electrically insulated from the connection signal pin 310 by the connection dielectric 320.

One side of the connection connector 300 is inserted into the first fixed connector 100, and the first fixed connector 100 allows a joint of the connection connector 300 to move on the basis of the inserted one side of the connection connector 300.

The first fixed connector 100 includes a first signal pin 110 configured to transmit high-frequency current, a first dielectric 120 surrounding the first signal pin 110, and a first ground 130 which is electrically insulated from the first signal pin 110 by the first dielectric 120 and forms the inner side of the first fixed connector 100 into which the one side of the connection connector 300 is inserted.

When the one side of the connection connector 300 is inserted into the first fixed connector 100, the connection signal pin 310 comes in contact with and is electrically connected to the first signal pin 110, and the connection ground 330 comes in contact with and is electrically connected to the first ground 130.

Here, the first ground 130 may include an inclined portion 132.

The inclined portion 132 is disposed below a limiting support portion 131, and a diameter of a space into which the connection connector 300 is inserted gradually decreases downward along the inclined portion 132.

In the case in which an external force is applied to the connection connector 300 from top to bottom, the connection connector 300 is inserted deeper into the first fixed connector 100, and the extent to which a connection protruding portion 331 is compressed inward by the inclined portion 132 changes according to the depth to which the connection connector 300 is inserted into the first fixed connector 100.

Here, the connection protruding portion 331 that is compressed inward forms an elastic restoration force, and due to the elastic restoration force, the connection protruding portion 331 moves upward along the inclined portion 132 until the connection protruding portion 331 is caught at the limiting support portion 131 or up to an allowable range of upward movement of the connection protruding portion 331.

The second fixed connector 200 includes a second signal pin 210 configured to transmit high-frequency current, a second dielectric 220 surrounding the second signal pin 210, and a second ground 230 which is electrically insulated from the second signal pin 210 by the second dielectric 220 and forms the inner side of the second fixed connector 200 into which the other side of the connection connector 300 is inserted.

When the other side of the connection connector 300 is inserted into the second fixed connector 200, the connection signal pin 310 comes in contact with and is electrically connected to the second signal pin 210, and the connection ground 330 comes in contact with and is electrically connected to the second ground 230.

As illustrated in FIG. 4, the connection ground 330 of the connector having the joint with the limited range of motion according to the first embodiment of the present invention includes the connection protruding portion 331, a connection limiting portion 332, a connection elastic portion 333, and a plurality of connection slits 334.

The connection protruding portion 331 is formed so that one end of the connection ground 330 protrudes outward.

The connection limiting portion 332 is adjacent to the connection protruding portion 331, has a thickness smaller than a thickness of the connection protruding portion 331, and comes in contact with the inner side of the first fixed connector 100 to limit a range of motion of the joint of the connection connector 300.

The connection elastic portion 333 is adjacent to the connection limiting portion 332 and has a thickness smaller than a thickness of the connection limiting portion 332.

The plurality of connection slits 334 are formed along a circumference of the connection protruding portion 331 and extend from one end of the connection connector 300 in a longitudinal direction of the connection connector 300 so that the connection protruding portion 331, the connection limiting portion 332, and the connection elastic portion 333 are separated into a plurality of pieces.

The connection connector 300 may be inserted into the first fixed connector 100, and the joint of the connection connector 300 may have a larger radius of horizontal rotation at the other side of the connection connector 300 than at the one side of the connection connector 300 that is inserted into the first fixed connector 100.

When the connection protruding portion 331 comes in contact with the inner side of the first fixed connector 100, an inner diameter of one side of the connection ground 330 narrows, and an elastic restoration force, which is a force attempting to restore the narrowed inner diameter, is generated at the one side of the connection ground 330.

In order to allow the elastic restoration force to be easily generated at the one side of the connection ground 330, a thickness of the connection elastic portion 333 may be formed smaller than the thickness of the connection limiting portion 332 and the thickness of the connection protruding portion 331.

Here, a taper is formed on a boundary surface between the connection limiting portion 332 and the connection elastic portion 333, and a thickness between the connection limiting portion 332 and the connection elastic portion 333 gradually decreases from the connection limiting portion 332 to the connection elastic portion 333

The taper formed on the boundary surface between the connection limiting portion 332 and the connection elastic portion 333 may disperse stress between the connection limiting portion 332 and the connection elastic portion 333 when the inner diameter of the one side of the connection ground 330 narrows due to the connection protruding portion 331 coming in contact with the inner side of the first fixed connector 100 and may prevent a section in which the inner diameter of the one side of the connection ground 330 narrows from being interrupted between the connection limiting portion 332 and the connection elastic portion 333 and expand the section from the connection protruding portion 331 to the connection elastic portion 333.

Figure 5:
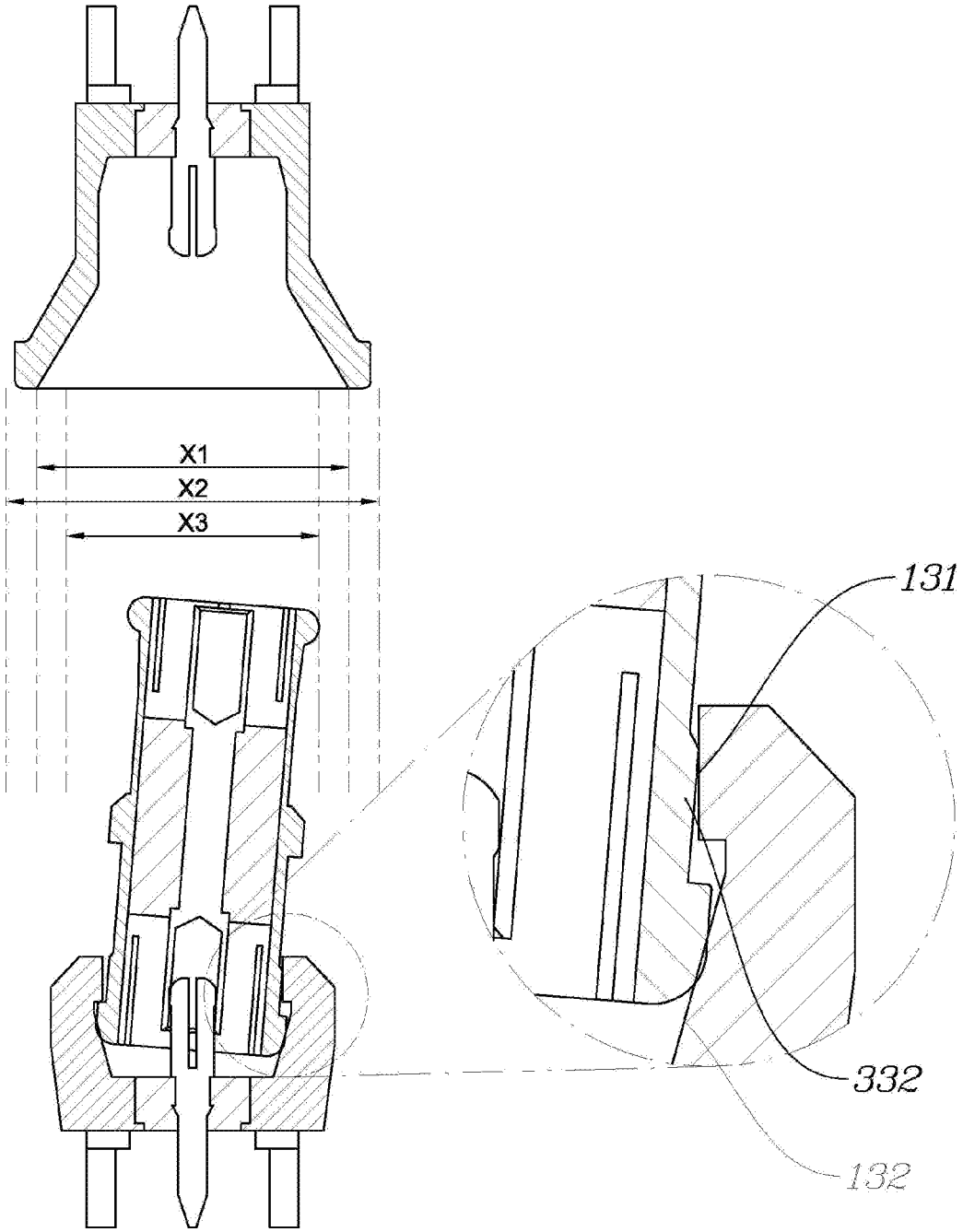

As illustrated in FIG. 5, the first ground 130 of the first fixed connector 100 of the connector having the joint with the limited range of motion according to the first embodiment of the present invention includes the limiting support portion 131.

The limiting support portion 131 has a vertical surface protruding toward the inner side of the first fixed connector 100 at a position corresponding to the connection limiting portion 332.

The connection limiting portion 332 may come in contact with the limiting support portion 131 and limit the range of motion of the joint of the connection connector 300 so that the joint of the connection connector 300 moves within a limited range X3 that is smaller than the conventional range of motion X2 of the joint of the connection connector 300.

Therefore, since the diameter X1 of the one end of the inner wall of the guide portion 231 does not need to be formed as large as in the conventional case, the width of the guide portion 231 may be minimized.

In this way, the connection limiting portion 332 and the limiting support portion 131 have an effect of limiting the range of motion of the joint of the connection connector 300.

Figure 6:
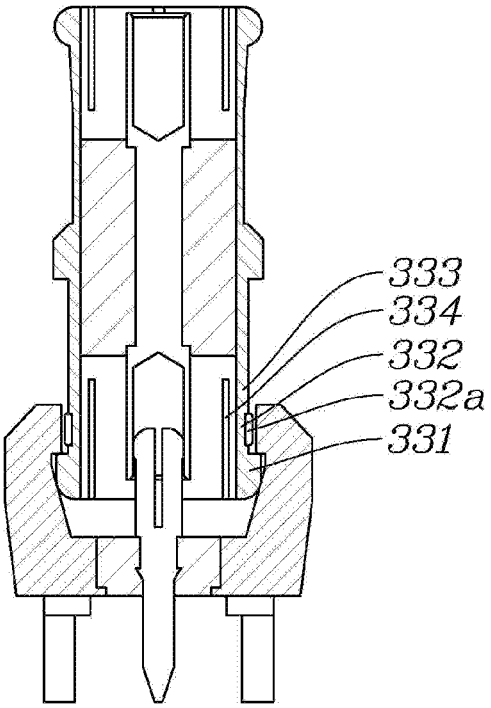
FIG. 6 is a view for describing a connector having a joint with a limited range of motion according to a second embodiment of the present invention.

As illustrated in FIG. 6, a connector having a joint with a limited range of motion according to a second embodiment of the present invention includes a connection connector 300, a first fixed connector 100, and a second fixed connector 200. Since this is identical to the first embodiment described above, description thereof will be omitted.

As illustrated in FIG. 6, a connection ground 330 of the connector having the joint with the limited range of motion according to the second embodiment of the present invention includes a connection protruding portion 331, a connection limiting portion 332, a connection elastic portion 333, and a plurality of connection slits 334.

The connection protruding portion 331 is formed so that one end of the connection ground 330 protrudes outward.

The connection limiting portion 332 is adjacent to the connection protruding portion 331.

The connection limiting portion 332 has a thickness smaller than a thickness of the connection protruding portion 331.

A rubber ring 332*a* is inserted into a groove formed along a circumference of the connection limiting portion 332.

The rubber ring 332*a* has a thickness larger than a depth of the groove formed in the connection limiting portion 332, and thus a portion of the rubber ring 332*a* is exposed to the outside of the groove formed in the connection limiting portion 332.

The rubber ring 332*a* may come in contact with the limiting support portion 131 and limit the range of motion of the joint of the connection connector 300.

The connection elastic portion 333 is adjacent to the connection limiting portion 332 and has a thickness smaller than a thickness of the connection protruding portion 331.

Here, the connection elastic portion 333 may have a thickness smaller than a thickness from an inner surface of the connection protruding portion 331 to an outer surface of the rubber ring 332*a* coupled to the connection protruding portion 331.

The plurality of connection slits 334 are formed along a circumference of the connection protruding portion 331 and extend from one end of the connection connector 300 in a longitudinal direction of the connection connector 300 so that the connection protruding portion 331, the connection limiting portion 332, and the connection elastic portion 333 are separated into a plurality of pieces.

In this way, the rubber ring 332*a* and the limiting support portion 131 have an effect of limiting the range of motion of the joint of the connection connector 300.

Figure 7:
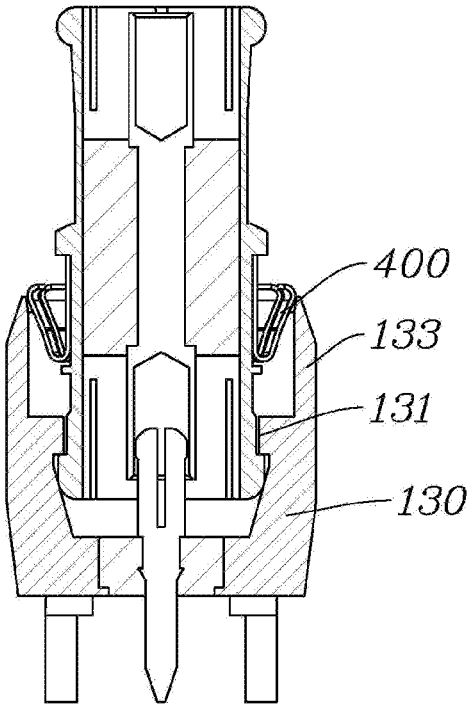
FIGS. 7 to 9 are views for describing a connector having a joint with a limited range of motion according to a third embodiment of the present invention.

As illustrated in FIG. 7, a connector having a joint with a limited range of motion according to a third embodiment of the present invention includes a connection connector 300, a first fixed connector 100, and a second fixed connector 200. Since this is identical to the first embodiment described above, description thereof will be omitted.

As illustrated in FIG. 7, the connector having the joint with the limited range of motion according to the third embodiment of the present invention includes an elastic limiting portion 400.

The elastic limiting portion 400 provides a relative elastic force along a circumference of an inner side of the first fixed connector 100 and limits a range of motion of the joint of the connection connector 300.

As illustrated in FIG. 7, the first fixed connector 100 of the connector having the joint with the limited range of motion according to the third embodiment of the present invention includes a fixed wall portion 133.

The fixed wall portion 133 is formed to extend upward from a first ground 130 and has a hollow, which has a width larger than a width of an inner wall of a limiting support portion 131, formed therein.

The elastic limiting portion 400 may come in contact with the fixed wall portion 133 to form an elastic restoration force and limit the range of motion of the joint of the connection connector 300.

Here, a portion of the elastic limiting portion 400 that corresponds to a position at which the connection connector 300 is slanted is compressed more than the remaining portion of the elastic limiting portion 400 and has a relatively higher elastic force.

Figure 8:
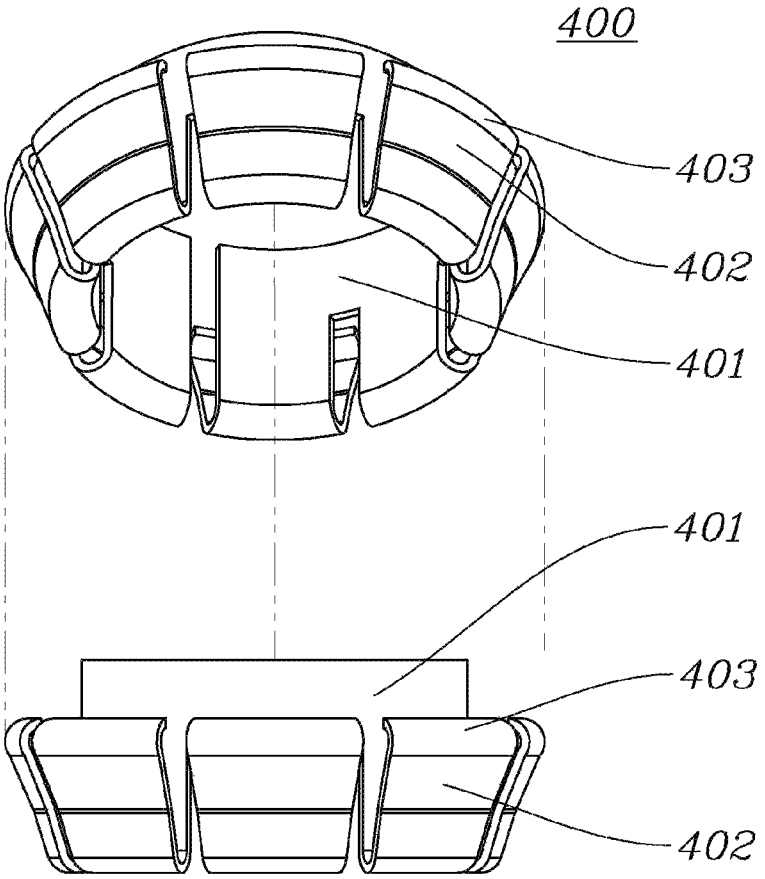

As illustrated in FIG. 8, the elastic limiting portion 400 of the connector having the joint with the limited range of motion according to the third embodiment of the present invention includes a body portion 401, a plurality of extending portions 402, and a contact portion 403.

The body portion 401 is formed by bending a pressed metal plate member and has a hollow formed therein.

The body portion 401 may be inserted into a groove formed in the connection connector 300.

Here, the groove formed in the connection connector 300 may be formed by a pair of protruding portions that are vertically spaced apart and protrude outward from a side surface of a connection ground 330.

The plurality of extending portions 402 are formed with slits therebetween and extend to be curved in a direction opposite to an extending direction of the body portion 401 from one end of the body portion 401 to face the body portion 401.

The contact portion 403 extends to be curved inward from one end of the extending portion 402 and has a curved surface formed at an outer side.

When the contact portion 403 comes in contact with the fixed wall portion 133, the extending portions 402 may be compressed in a direction approaching the body portion 401 to form an elastic restoration force and limit the range of motion of the joint of the connection connector 300.

Figure 9:
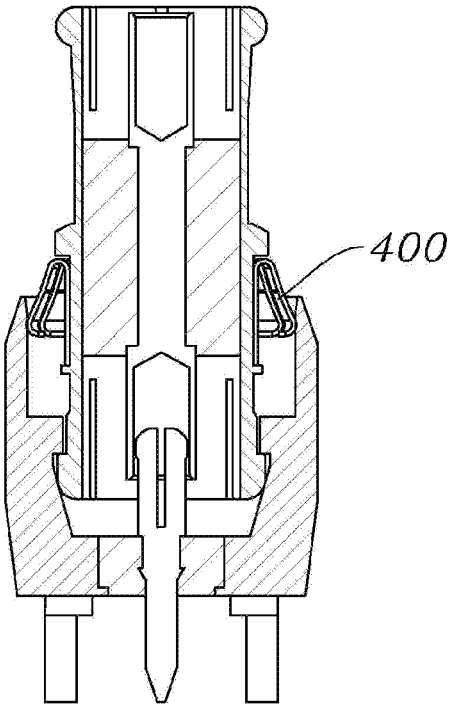

FIG. 9 is a view relating to an embodiment in which the elastic limiting portion 400 is coupled in another direction.

In this way, the elastic limiting portion 400 and the fixed wall portion 133 have an effect of limiting the range of motion of the joint of the connection connector 300.

Figure 10:
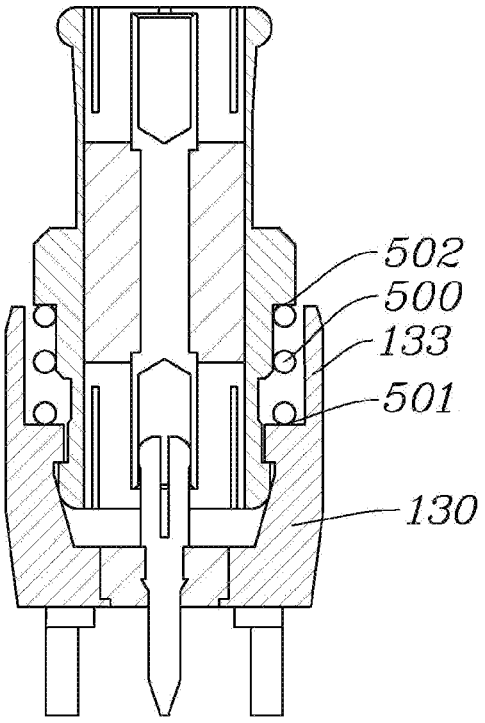
FIG. 10 is a view for describing a connector having a joint with a limited range of motion according to a fourth embodiment of the present invention.

As illustrated in FIG. 10, a connector having a joint with a limited range of motion according to a fourth embodiment of the present invention includes a connection connector 300, a first fixed connector 100, and a second fixed connector 200. Since this is identical to the first embodiment described above, description thereof will be omitted.

As illustrated in FIG. 10, the connector having the joint with the limited range of motion according to the fourth embodiment of the present invention further includes a spring 500.

The spring 500 may be supported by the connection connector 300 and the first fixed connector 100 to form an elastic restoration force, which restores distortion caused by motion of the joint of the connection connector 300, and limit a range of motion of the joint of the connection connector 300.

As illustrated in FIG. 10, the connector having the joint with the limited range of motion according to the fourth embodiment of the present invention includes a first ground 130 including a fixed wall portion 133 and a first stepped portion 501 and a connection ground 330 including a second stepped portion 502.

The fixed wall portion 133 is formed to extend upward from the first ground 130 and has a hollow, which has a width larger than a width of an inner wall of a limiting support portion 131, formed therein.

The first stepped portion 501 has a flat area that is disposed at an inner side of the fixed wall portion 133 and is perpendicular to the fixed wall portion 133.

The second stepped portion 502 has a flat area that protrudes from the connection ground 330 at a position corresponding to the first stepped portion 501 and is perpendicular to the connection ground 330.

The flat area of the first stepped portion 501 is disposed to face the flat area of the second stepped portion 502. The spring 500 is supported by one end coming in contact with the first stepped portion 501 and the other end coming in contact with the second stepped portion 502, and a portion between the first stepped portion 501 and the second stepped portion 502 is surrounded by the fixed wall portion 133.

When one side at an upper end of the spring 500 is distorted, the fixed wall portion 133 may support the other side at a lower end of the spring 500, which is symmetrical to the one side at the upper end of the spring 500, and restore the distorted spring.

The spring 500 may come in contact with the fixed wall portion 133 to form an elastic restoration force and limit the range of motion of the joint of the connection connector 300.

In this way, the spring 500 and the fixed wall portion 133 have an effect of limiting the range of motion of the joint of the connection connector 300.

Each of the third embodiment and the fourth embodiment described above may be combined with the first embodiment or the second embodiment.

For example, a connector having a joint with a limited range of motion may include the connection protruding portion 331, the connection limiting portion 332, and the connection elastic portion 333 according to the first embodiment while including the elastic limiting portion 400 according to the third embodiment.

The exemplary embodiments of the present invention have been described above in detail, but the present invention is not limited thereto and may be practiced in various other ways within the scope of the claims below.

DESCRIPTION OF REFERENCE NUMERALS

| | |
|---|---|
| 100: first fixed connector | 110: first signal pin |
| 120: first dielectric | 130: first ground |
| 131: limiting support portion | 132: inclined portion |

-continued

| | |
|---|---|
| 133: fixed wall portion | 200: second fixed connector |
| 210: second signal pin | 220: second dielectric |
| 230: second ground | 231: guide portion |
| 300: connection connector | 310: connection signal pin |
| 320: connection dielectric | 330: connection ground |
| 331: connection protruding portion | 332: connection limiting portion |
| 332a: rubber ring | 333: connection elastic portion |
| 334: connection slit | 400: elastic limiting portion |
| 401: body portion | 402: extending portion |
| 403: contact portion | 500: spring |
| 501: first stepped portion | 502: second stepped portion |

We claim:

1. A connector including a joint with a limited range of motion, the connector comprising:

a connection connector including a connection signal pin, a connection dielectric surrounding the connection signal pin, and a connection ground electrically insulated from the connection signal pin by the connection dielectric; and a first fixed connector into which one side of the connection connector is inserted and which allows a joint of the connection connector to move on the basis of the inserted one side of the connection connector, wherein the connection ground includes:

a connection protruding portion formed so that one end of the connection ground protrudes outward;

a connection limiting portion which is adjacent to the connection protruding portion, has a thickness smaller than a thickness of the connection protruding portion, and comes in contact with an inner side of the first fixed connector to limit a range of motion of the joint of the connection connector;

a connection elastic portion which is adjacent to the connection limiting portion and has a radial thickness smaller than a radial thickness of the connection limiting portion; and a plurality of connection slits which are formed along a circumference of the connection protruding portion, and extend from one end of the connection connector in a longitudinal direction of the connection connector and extend to a portion of the connection elastic portion in the longitudinal direction of the connection connector so that the connection protruding portion, the connection limiting portion, and the connection elastic portion are separated into a plurality of pieces.

2. The connector of claim 1, wherein a taper is formed on a boundary surface between the connection limiting portion and the connection elastic portion, and a thickness gradually decreases from the connection limiting portion to the connection elastic portion.

3. The connector of claim 1, wherein:

the first fixed connector includes a first ground forming the inner side of the first fixed connector into which the one side of the connection connector is inserted; and the first ground includes a limiting support portion which has a vertical surface protruding toward the inner side of the first fixed connector at a position corresponding to the connection limiting portion.

4. The connector of claim 1, wherein:

the first fixed connector includes a first ground forming the inner side of the first fixed connector into which the one side of the connection connector is inserted; and the first ground includes an inclined portion along which a diameter of a space into which the connection connector is inserted gradually narrows downward.

5. The connector of claim 1, further comprising a spring which is supported by the connection connector and the first fixed connector and provides an elastic restoration force, which restores distortion caused by motion of the joint of the connection connector, to limit a range of motion of the joint of the connection connector, wherein:

the first fixed connector includes a first ground forming the inner side of the first fixed connector into which the one side of the connection connector is inserted;

the first ground includes a fixed wall portion which is formed by one end of the first fixed connector extending upward and has a hollow formed therein and a first stepped portion which has a flat area that is disposed at an inner side of the fixed wall portion and is perpendicular to the fixed wall portion;

the connection ground includes a second stepped portion which has a flat area that protrudes from the connection ground at a position corresponding to the first stepped portion and is perpendicular to the connection ground;

the spring is supported by one end coming in contact with the first stepped portion and the other end coming in contact with the second stepped portion; and a portion between the first stepped portion and the second stepped portion is surrounded by the fixed wall portion.

6. The connector of claim 5, wherein the connection limiting portion includes a rubber ring, of which a portion is exposed, inserted into a groove formed along a circumference thereof to limit a range of motion of the joint of the connection connector.

7. A connector including a joint with a limited range of motion, the connector comprising:

a connection connector including a connection signal pin, a connection dielectric surrounding the connection signal pin, and a connection ground electrically insulated from the connection signal pin by the connection dielectric; and a first fixed connector into which one side of the connection connector is inserted and which allows a joint of the connection connector to move on the basis of the inserted one side of the connection connector, wherein the connection ground includes:

a connection protruding portion formed so that one end of the connection ground protrudes outward;

a connection limiting portion which is adjacent to the connection protruding portion, has a thickness smaller than a thickness of the connection protruding portion, and has a rubber ring, of which a portion is exposed, inserted into a groove formed along a circumference thereof to limit a range of motion of the joint of the connection connector;

a connection elastic portion which is adjacent to the connection limiting portion and has a thickness smaller than a thickness of the connection protruding portion; and a plurality of connection slits which are formed along a circumference of the connection protruding portion and extend from one end of the connection connector in a longitudinal direction of the connection connector so that the connection protruding portion, the connection limiting portion, and the connection elastic portion are separated into a plurality of pieces.

8. The connector of claim 7, wherein a taper is formed on a boundary surface between the connection limiting portion and the connection elastic portion, and a thickness gradually decreases from the connection limiting portion to the connection elastic portion.

9. The connector of claim 7, wherein:

the first fixed connector includes a first ground forming the inner side of the first fixed connector into which the one side of the connection connector is inserted; and the first ground includes a limiting support portion which has a vertical surface protruding toward the inner side of the first fixed connector at a position corresponding to the connection limiting portion.

10. The connector of claim 7, wherein:

the first fixed connector includes a first ground forming the inner side of the first fixed connector into which the one side of the connection connector is inserted; and the first ground includes an inclined portion along which a diameter of a space into which the connection connector is inserted gradually narrows downward.

11. The connector of claim 7, further comprising a spring which is supported by the connection connector and the first fixed connector and provides an elastic restoration force, which restores distortion caused by motion of the joint of the connection connector, to limit a range of motion of the joint of the connection connector, wherein:

the first fixed connector includes a first ground forming the inner side of the first fixed connector into which the one side of the connection connector is inserted;

the first ground includes a fixed wall portion which is formed by one end of the first fixed connector extending upward and has a hollow formed therein and a first stepped portion which has a flat area that is disposed at an inner side of the fixed wall portion and is perpendicular to the fixed wall portion;

the connection ground includes a second stepped portion which has a flat area that protrudes from the connection ground at a position corresponding to the first stepped portion and is perpendicular to the connection ground;

the spring is supported by one end coming in contact with the first stepped portion and the other end coming in contact with the second stepped portion; and a portion between the first stepped portion and the second stepped portion is surrounded by the fixed wall portion.

12. A connector including a joint with a limited range of motion, the connector comprising:

a connection connector including a connection signal pin, a connection dielectric surrounding the connection signal pin, and a connection ground electrically insulated from the connection signal pin by the connection dielectric;

a first fixed connector into which one side of the connection connector is inserted and which allows a joint of the connection connector to move on the basis of the inserted one side of the connection connector; and an elastic limiting portion which provides a relative elastic force along a circumference of an inner side of the first fixed connector to limit a range of motion of the joint of the connection connector, wherein the elastic limiting portion includes:

a body portion including a hollow, into which the connection connector is inserted, formed therein that is formed by bending a pressed metal plate member;

a plurality of extending portions which are formed with slits therebetween and extend to be curved in a direction opposite to an extending direction of the body portion from one end of the body portion to face the body portion; and a contact portion which extends to be curved inward from one end of the extending portion and has a curved surface, which comes in contact with the first fixed connector, formed at an outer side.

13. The connector of claim 12, wherein:

the first fixed connector includes a first ground forming the inner side of the first fixed connector into which the one end of the connection connector is inserted;

the first ground includes a fixed wall portion which is formed to extend upward from the first ground and has a hollow formed therein; and the elastic limiting portion comes in contact with the fixed wall portion to form an elastic restoration force.

14. The connector of claim 13, wherein the connection ground includes:

a connection protruding portion formed so that one end of the connection ground protrudes outward;

a connection limiting portion which is adjacent to the connection protruding portion, has a thickness smaller than a thickness of the connection protruding portion, and comes in contact with an inner side of the first fixed connector to limit a range of motion of the joint of the connection connector;

a connection elastic portion which is adjacent to the connection limiting portion and has a thickness smaller than a thickness of the connection limiting portion; and a plurality of connection slits which are formed along a circumference of the connection protruding portion and extend from one end of the connection connector in a longitudinal direction of the connection connector so that the connection protruding portion, the connection limiting portion, and the connection elastic portion are separated into a plurality of pieces.

15. The connector of claim 13, wherein the connection ground includes:

a connection protruding portion formed so that one end of the connection ground protrudes outward;

a connection limiting portion which is adjacent to the connection protruding portion, has a thickness smaller than a thickness of the connection protruding portion, and has a rubber ring, of which a portion is exposed, inserted into a groove formed along a circumference thereof to limit a range of motion of the joint of the connection connector;

a connection elastic portion which is adjacent to the connection limiting portion and has a thickness smaller than a thickness of the connection protruding portion; and a plurality of connection slits which are formed along a circumference of the connection protruding portion and extend from one end of the connection connector in a longitudinal direction of the connection connector so that the connection protruding portion, the connection limiting portion, and the connection elastic portion are separated into a plurality of pieces.

* * * * *